US009332888B2

(12) United States Patent
Basesme et al.

(10) Patent No.: US 9,332,888 B2
(45) Date of Patent: May 10, 2016

(54) DISHWASHER WITH IMPROVED LEAK-PROOFING

(71) Applicant: Arcelik Anonim Sirketi, Istanbul (TR)

(72) Inventors: Tugrul Basesme, Istanbul (TR); Ismail Cem Bastuji, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 0 days.

(21) Appl. No.: 14/434,387

(22) PCT Filed: Sep. 24, 2013

(86) PCT No.: PCT/EP2013/069868
§ 371 (c)(1),
(2) Date: Apr. 8, 2015

(87) PCT Pub. No.: WO2014/056721
PCT Pub. Date: Apr. 17, 2014

(65) Prior Publication Data

US 2015/0257625 A1 Sep. 17, 2015

(30) Foreign Application Priority Data

Oct. 8, 2012 (TR) ..... A 2012/11486

(51) Int. Cl.
*A47L 15/42* (2006.01)

(52) U.S. Cl.
CPC ..... *A47L 15/4212* (2013.01); *A47L 15/4272* (2013.01)

(58) Field of Classification Search
CPC . A47L 15/42; A47L 15/4212; A47L 15/4246; A47L 15/4251; A47L 15/4272
USPC ..... 312/228, 229, 257.1; 134/200, 201
See application file for complete search history.

(56) References Cited

U.S. PATENT DOCUMENTS

| | | | | | |
|---|---|---|---|---|---|
| 4,359,250 | A * | 11/1982 | Jenkins | A47L 15/4246 | 312/228 |
| 5,299,586 | A * | 4/1994 | Jordan | A47L 15/4225 | 134/111 |
| 5,368,379 | A * | 11/1994 | Wrangberth | A47L 15/4246 | 134/200 |
| 5,603,557 | A * | 2/1997 | Marks | A47L 15/4251 | 312/265.6 |
| 2005/0017609 | A1 * | 1/2005 | Kucuk | A47L 15/4246 | 312/228 |
| 2009/0205378 | A1 | 8/2009 | Helgesen | | |

FOREIGN PATENT DOCUMENTS

| | | | |
|---|---|---|---|
| EP | 1210903 | A2 | 6/2002 |
| EP | 1947406 | A2 | 7/2008 |
| EP | 2491846 | A2 | 8/2012 |
| WO | 2009/068395 | A1 | 6/2009 |

OTHER PUBLICATIONS

International Search Report of WO2014/056721 ( and references cited therein) and Written Opinion of International Searching Authority.

* cited by examiner

*Primary Examiner* — James O Hansen
(74) *Attorney, Agent, or Firm* — Venjuris P.C.

(57) ABSTRACT

The present invention relates to a dishwasher (1) comprising a tub (2) wherein the items to be washed are placed, a sump (3) which is located under the tub (2) and wherein the wash water accumulates, a rectangular casing (4) which provides the tub (2) to be carried at a certain height from the floor and at least one cover (5) which provides the bottom portion of the body (9) to be almost completely covered.

8 Claims, 4 Drawing Sheets

DISHWASHER WITH IMPROVED LEAK-PROOFING

Figure 1:
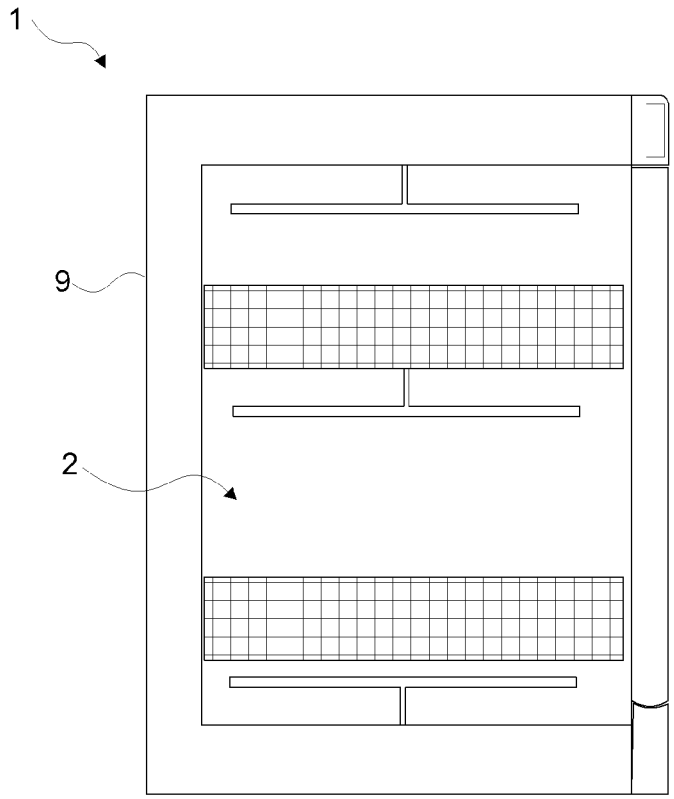

The present invention relates to a dishwasher comprising a cover which covers the bottom side of the body.

Dishwashers comprise a rectangular casing that provides the tub wherein the washing process is performed to be carried at a certain height from the floor, and a cover that covers the bottom side of the casing. The said cover is located at the lowermost portion of the dishwasher and covers the bottom side of the dishwasher, thereby providing the protection thereof. The cover and the casing are produced from plastic material. The cover is mounted to the casing by means of claws. However, gaps remain after the cover is mounted to the casing. Therefore, in cases such as malfunctioning of the dishwasher, the water overflowing from the components such as the sump leaks out of the dishwasher by passing through these gaps.

In the state of the art European Patent Document No. EP1210903, a dishwasher is described, that comprises a protective tray located at the lowermost portion of the dishwasher and having a bottom and sidewalls carrying the weight and a tube allowing the water to be discharged in case water accumulates inside the dishwasher.

The aim of the present invention is the realization of a dishwasher wherein the leak-proofing is improved at the bottom side of the body.

The dishwasher realized in order to attain the aim of the present invention, explicated in the first claim and the respective claims thereof, comprises a frame-shaped casing located under the body, at least one cover placed into the casing and almost completely covering the bottom side of the body, at least one housing arranged on the casing and at least one claw which extends from the cover and prevents the cover from detaching from the casing when at least partially seated in the housing.

The dishwasher of the present invention comprises at least one guide which extends from the casing towards the claw and prevents water from entering into the opening between the claw and the housing by almost completely covering the front of the claw portion facing inside the body when the cover is mounted to the casing. The guide is situated on the casing so as to remain above the housing in the vertical direction. The guide almost completely covers the side of the claw facing inside the casing. Thus, the water overflowing from the components such as the sump is prevented from remaining at the cover and leaving the dishwasher.

In an embodiment of the present invention, the dishwasher comprises the claw that is at least partially in U shape, and the guide that surrounds the claw portion facing inside the body. The flexibility of the claw is increased by means of its shape.

In an embodiment of the present invention, the guide is L-shaped. By means of its shape, the guide covers the front of the claw portion facing inside the casing and prevents the water, overflowing from the components such as the sump, from reaching the claw.

In an embodiment of the present invention, the guide is produced as integrated with the casing. Thus, saving from assembly time is maintained.

The dishwasher realized in order to attain the aim of the present invention is illustrated in the attached figures, where:

FIG. 1—is the perspective view of a dishwasher.

Figure 2:
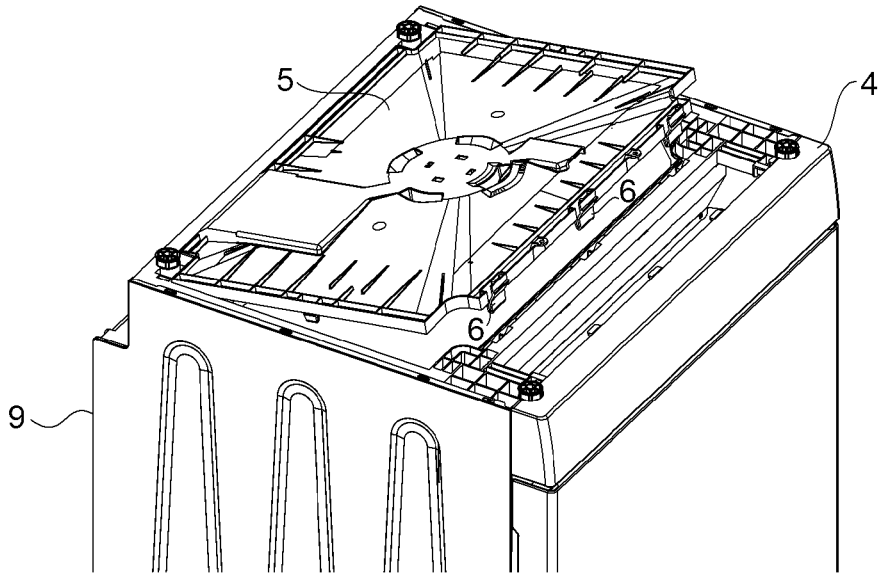

FIG. 2—is the bottom partial view of the dishwasher.

Figure 3:
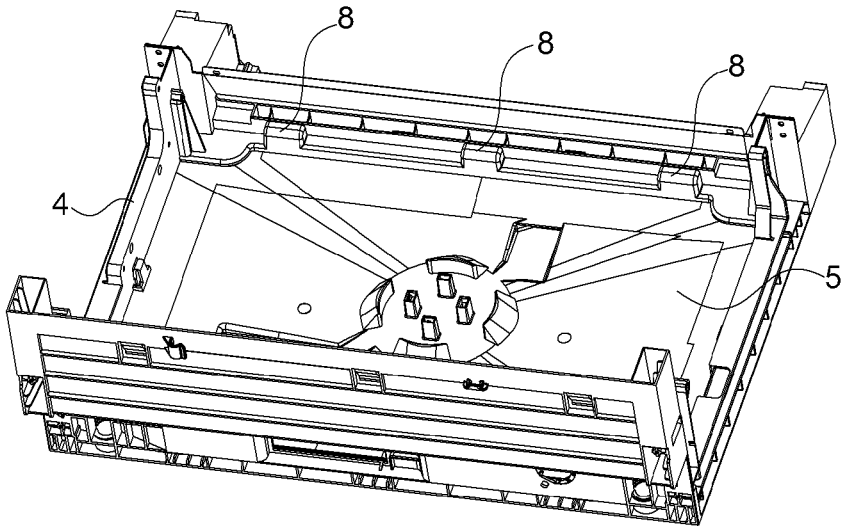

FIG. 3—is the perspective view of a casing and a cover mounted thereunder.

Figure 4:
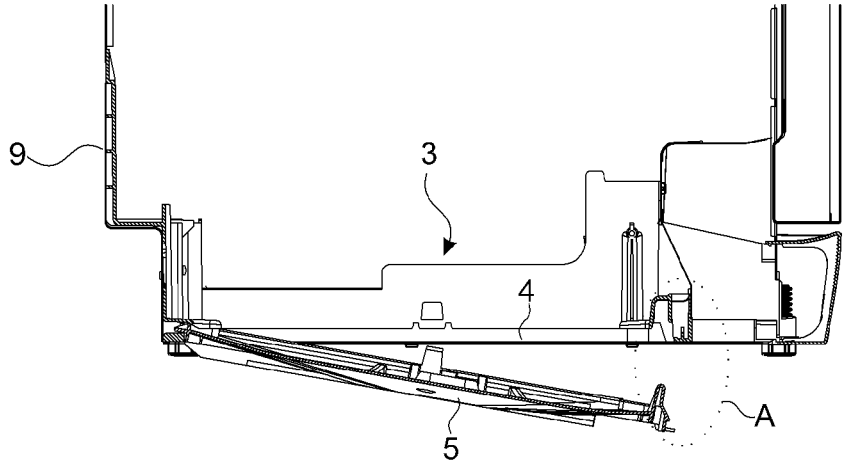

FIG. 4—is the partial view of the dishwasher before the cover is mounted to the casing.

Figure 5:
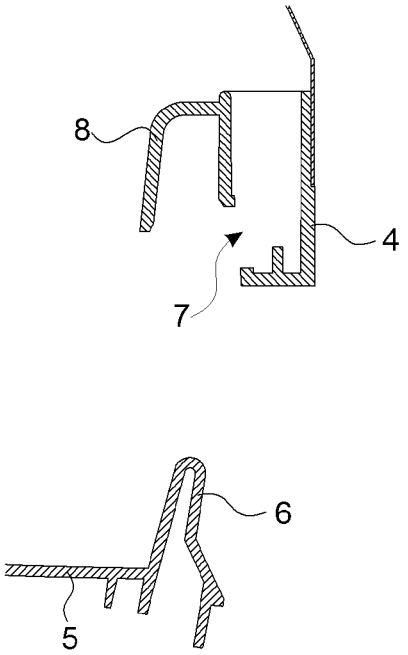

FIG. 5—is the view of detail A in FIG. 4.

Figure 6:
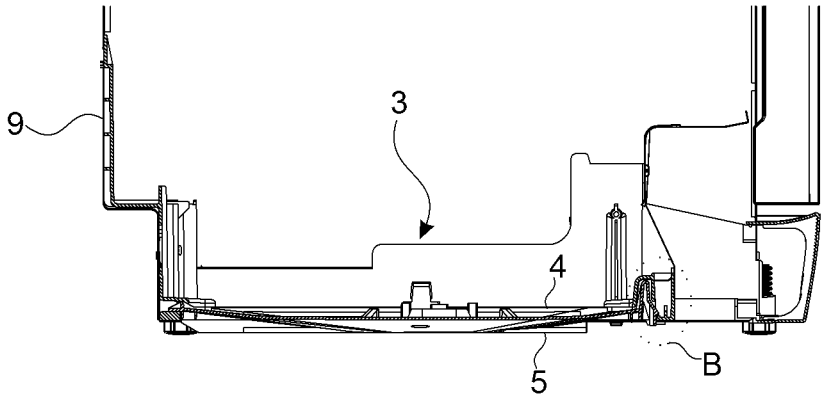

FIG. 6—is the partial view of the dishwasher after the cover is mounted to the casing.

Figure 7:
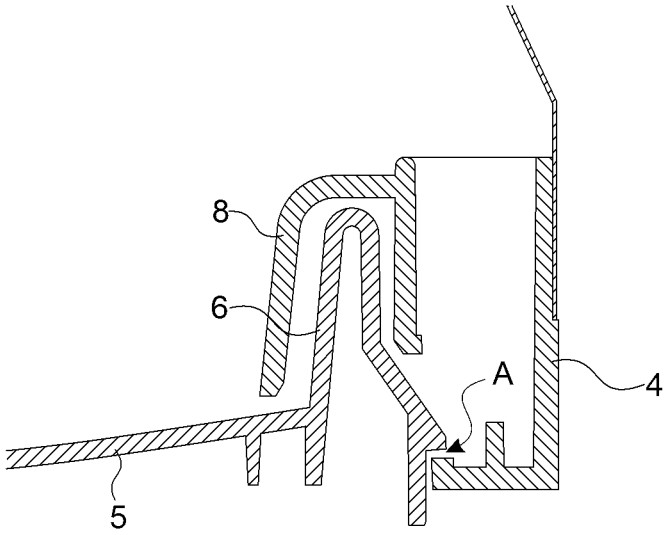

FIG. 7—is the view of detail B in FIG. 6.

The elements illustrated in the figures are numbered as follows:

1. Dishwasher
2. Tub
3. Sump
4. Casing
5. Cover
6. Claw
7. Housing
8. Guide
9. Body The dishwasher (1) comprises a body (9), a tub (2) wherein the items to be washed are placed, a sump (3) which is located under the tub (2) and wherein the wash water accumulates, a rectangular casing (4) which provides the tub (2) to be carried and which is located at the lower side of the body (9), a cover (5) which provides the bottom portion of the body (9) to be almost completely covered, at least one housing (7) formed on the casing (4) and one or more than one claw (6) which extends from at least one edge of the cover (5) and prevents the cover (5) from detaching from the casing (4) when placed in the housing (7). The claw (6) extends from the cover (5) towards the casing (4). The housing (7) is located on the casing (4) surface facing the cover (5). By means of the claw (6) seated in the housing (7), the cover (5) is provided to be fixed to the casing (4). In the event of a water overflow from the sump (3) occurring in cases such as malfunctioning, the cover (5) stores the overflowing water and furthermore provides sound insulation (FIG. 1, FIG. 2, FIG. 3, FIG. 4, FIG. 6).

The dishwasher (1) of the present invention comprises at least one guide (8) which extends from the casing (4) towards the claw (6) and prevents water from entering into the gap (A) between the claw (6) and the housing (7) by almost completely covering the claw (6) when the cover (5) is mounted to the casing (4). The guide (8) extends from over the housing (7) towards the back of the claw (6). When the cover (5) is fixed to the casing (4), the claw (6) is seated into the housing (7). The guide (8) almost completely covers the portion of the claw (6) facing inside the body (9). The guide (8) provides the gap (A), remaining between the housing (7) and the claw (6) when the cover (5) is mounted to the casing (4), to be covered and prevents the water leakage through the gap (A) remaining between the housing (7) and the claw (6). Thus, the water overflowing from the sump (3) or other components and flowing under the tub (2) is prevented from leaking out from between the cover (5) and the casing (4), and the water is provided to completely accumulate on the cover (5) (FIG. 5, FIG. 7).

In an embodiment of the present invention, the dishwasher (1) comprises the U-shaped claw (6) and the guide (8) that surrounds the claw (6) portion facing inside the casing (4) when the cover (5) is mounted to the casing (4). The claw (6), the flexibility of which is improved by means of its U-shape, can be easily attached to/detached from the housing (7). One end of the claw (6) is connected to the cover (5). The other open end of the claw (6) enters into the housing (7) and provides the cover (5) to be fixed to the casing (4). The guide (8) prevents the water overflowing from the components such as the sump (3) from reaching the claw (6) and provides the water to remain on the cover (5). Thus, the water is prevented from leaking out of the dishwasher (1) through the gap (A) remaining between the claw (6) and the housing (7) when the cover (5) is mounted to the casing (4) (FIG. 5, FIG. 7).

In an embodiment of the present invention, the guide (8) is at least partially L-shaped. The portion of the U-shaped claw (6) facing the inside of the casing (4) is covered by the guide (8). Almost the entire rear portion of the claw (6) and the L-shaped claw (6) are situated opposite to one another (FIG. 5, FIG. 7).

In an embodiment of the present invention, the guide (8) is produced integrated with the casing (4). The guide (8) and the casing (4) being produced as a single piece provides ease of production.

By means of the present invention, a dishwasher (1) is realized wherein water leakage to the outside from between the casing (4) and the cover (5), which are interlocked so as to provide leak-proofing, is prevented. The guide (8) prevents the water overflowing from the components such as the sump (3) from reaching the claw (6) and provides the water to remain on the cover (5). Thus, the water is prevented from leaking out of the dishwasher (1) through the gap (A) remaining between the claw (6) and the housing (7) when the cover (5) is mounted to the casing (4).

It is to be understood that the present invention is not limited to the embodiments disclosed above and a person skilled in the art can easily introduce different embodiments. These should be considered within the scope of the protection postulated by the claims of the present invention.

The invention claimed is:

1. A dishwasher (1) comprising a body (9), a tub (2) wherein the items to be washed are placed, a sump (3) which is located under the tub (2) where wash water accumulates, a rectangular casing (4) which provides the tub (2) to be carried and which is located at a lower side of the body (9), a cover (5) which provides a bottom portion of the body (9) to be almost completely covered, at least one housing (7) formed on the casing (4) and at least one claw (6) which extends from at least one edge of the cover (5) and prevents the cover (5) from detaching from the casing (4) when placed in the housing (7), and at least one guide (8) which extends from the casing (4) towards the claw (6) and prevents water from entering into a gap (A) between the at least one claw (6) and the housing (7) by almost completely covering the claw (6) when the cover (5) is mounted to the casing (4).

2. The dishwasher (1) as in claim 1, wherein the at least one claw is a U-shaped claw (6) and the at least one guide (8) that surrounds the at least one claw (6) portion facing inside the casing (4) when the cover (5) is mounted to the casing (4).

3. The dishwasher (1) as in claim 2, wherein the at least one guide (8) that is produced integrated with the casing (4).

4. The dishwasher (1) as in claim 2, wherein the at least one guide (8) that is at least partially L-shaped.

5. The dishwasher (1) as in claim 4, wherein the at least one guide (8) that is produced integrated with the casing (4).

6. The dishwasher (1) as in claim 1, wherein the at least one guide (8) that is at least partially L-shaped.

7. The dishwasher (1) as in claim 6, wherein the at least one guide (8) that is produced integrated with the casing (4).

8. The dishwasher (1) as in claim 1, wherein the at least one guide (8) that is produced integrated with the casing (4).

* * * * *